US006129287A

United States Patent [19]

Hirose et al.

[11] Patent Number: 6,129,287

[45] Date of Patent: Oct. 10, 2000

[54] VISCOUS FLUID TYPE HEAT GENERATING APPARATUS

[75] Inventors: Tatsuya Hirose; Takashi Ban; Shigeru Suzuki; Tatsuyuki Hoshino; Hidefumi Mori; Yasuhiro Fujiwara, all of Kariya, Japan

[73] Assignee: Kabushiki Kaisha Toyoda Jidoshokki Seisakusho, Kariya, Japan

[21] Appl. No.: 09/286,716

[22] Filed: Apr. 6, 1999

[30] Foreign Application Priority Data

Apr. 7, 1998 [JP] Japan ..... 10-094566

[51] Int. Cl.[7] ..... B60H 1/02

[52] U.S. Cl. ..... 237/12.3 R; 122/26; 126/247

[58] Field of Search ..... 237/12.3 R, 12.3 B; 126/247; 122/26; 123/41.31, 142.5 R

[56] References Cited

U.S. PATENT DOCUMENTS

| | | | |
|---|---|---|---|
| 4,365,614 | 12/1982 | Grover | 126/247 |
| 4,721,066 | 1/1988 | Newman, Sr. et al. | 122/26 |
| 4,974,778 | 12/1990 | Bertling | 237/12.3 |
| 5,829,676 | 11/1998 | Ban et al. | 237/12.3 R |
| 5,842,635 | 12/1998 | Okabe et al. | 237/12.3 R |

FOREIGN PATENT DOCUMENTS 10-029423 2/1998 Japan .

*Primary Examiner*—Henry Bennett
*Assistant Examiner*—Derek S. Boles
*Attorney, Agent, or Firm*—Woodcock Washburn Kurtz Mackiewicz & Norris LLP

[57] ABSTRACT

A viscous fluid type heat generating apparatus having a housing forming a cylindrical heat-generating chamber having a cylindrical wall surface and an axially spaced flat annular wall surface, and a rotatably supported rotor element having a cylindrical base portion and an axially extending tubular portion integral with the base portion forming a substantially cylindrical outer face and a cavity portion used as a fluid-storing chamber, the cylindrical portion of the rotor element cooperating with the cylindrical wall surface of the housing to define a main part of a heat-generating gap holding a viscous fluid which generates heat in response to an application of a shearing force to the viscous fluid in response to the rotation of the rotor element. The heat generating apparatus further having an intercommunicating passage providing a fluid communication between the heat-generating gap and the fluid storing chamber to thereby cause a circulation of the viscous fluid during the rotation of the rotor element, and a flow rate controlling actuator controlling an amount of circulation of the viscous fluid in response to a change in the rotating speed of the rotor element.

14 Claims, 7 Drawing Sheets

VISCOUS FLUID TYPE HEAT GENERATING APPARATUS

BACKGROUND OF THE INVENTION

1. Field of the Invention

The present invention relates to a viscous fluid type heat generating apparatus adapted for being incorporated into a vehicle heating system to be used as a heat-generating source.

2. Description of the Related Art

A viscous fluid type heat generating apparatus intended for use in a vehicle climate controlling system is disclosed in Japanese Unexamined Patent publication (Kokai) No. 10-29423 (JP-A-'423). The viscous fluid type heat generating apparatus of JP-A-'423 has a housing in which a heat-generating chamber and a heat receiving chamber, working as a water jacket and arranged adjacent to the heat-generating chamber to pass a heat exchanging fluid therethrough are formed. A drive shaft is supported to rotate via bearing devices and shaft sealing devices in the housing, and a pulley element is fixedly mounted on a front end part of the drive shaft to be rotationally driven through a belt by a vehicle engine. A rotor element is mounted on a rear end of the drive shaft to be rotatable within the heat-generating chamber. The rotor element has a pair of axially spaced fixing plates and a cylindrical outer peripheral member having opposite ends fixed to the pair of fixing plates. The heat-generating chamber has a cylindrical inner wall surface confronting the outer surface of the cylindrical outer peripheral member to define a small closed annular gap to be filled with a viscous fluid, such as silicone oil. The rotor element generates heat in the viscous fluid when rotated. The rotor element has a storing region inside the cylindrical outer peripheral member provided for storing a part of the viscous fluid without it being subjected to a shearing action applied by the rotating rotor element. The storing region fluidly communicates with the above-mentioned small heat-generating gap via withdrawal passages formed in the fixing plates. The small heat-generating gap also communicates with the storing region via fluid supply passages formed in the cylindrical outer peripheral member so that the viscous fluid can be supplied from the storing region into the heat-generating small gap.

In the described viscous fluid type heat generating apparatus as incorporated into a vehicle heating system, the rotor element rotates in the heat-generating chamber when the drive shaft is driven by the vehicle engine, and the viscous fluid in the heat-generating chamber is subjected to a shearing action within the gap between the inner wall surface of the heat-generating chamber and the outer surface of the rotor element to generate heat. The heat generated in the viscous fluid is transmitted to the heat exchanging liquid flowing through the heat receiving chamber, i.e., the water jacket, and is carried to a heat circuit by which the heat is applied to a heated area, i.e., a passenger compartment of the vehicle.

During the rotation of the rotor element, the viscous fluid is subjected to a centrifugal force by which the viscous fluid is moved from the storing region into the small annular gap via the fluid supply passages, and from the small annular gap into the storing region via the withdrawal passages. Namely, a movement of the viscous fluid occurs in the viscous fluid heat generating apparatus. Therefore, it does not occur that a specified portion of the viscous fluid is constantly subjected to the shearing action by the rotor element of the heat generating apparatus. Accordingly, thermal and mechanical degradation of the heat-generating performance of the viscous fluid can be prevented. Nevertheless, in viscous fluid type heat generating apparatus, the amount of the circulation of the viscous fluid through the small circulatory annular gap, the withdrawal passages, the storing region, and the supply passages for a unit time changes in response to a change in the rotating speed of the drive shaft and the rotor element. Thus, the heat generating apparatus might generate excessive heat when the rotor element is rotated at a very high speed, and as a result, the degradation of the heat-generating performance of the viscous fluid may occur.

More specifically, when the drive shaft is rotated at a relatively low speed to rotate the rotor element at the same low speed, the viscous fluid in the storing chamber is not subjected to any appreciable centrifugal force. Therefore, the amount of circulation of the viscous fluid through the storing region and the small annular gap generating heat is relatively small. The viscous fluid in the small annular gap is subjected to a suitable shearing action applied by the rotor element rotating at a relatively low speed. Thus, the viscous fluid generates a suitable amount of heat in the small annular gap to be effectively transmitted to the heat exchanging liquid flowing through the heat receiving chamber. Therefore, degradation in the heat-generating performance of the viscous fluid does not occur while exhibiting a desirable heat-generating performance.

On the other hand, when the drive shaft is rotated at a high speed to rotate the rotor element at the same high speed, the viscous fluid held in the storing region of the rotor element is subjected to a large centrifugal force. Therefore, a relatively large amount of the viscous fluid is circulated through the storing region and the small annular gap for heat generation, via the supply and the withdrawal passages. Accordingly, the viscous fluid is repeatedly subjected to a large shearing action and, eventually generates an excessive amount of heat. In addition, the circulation of the large amount of viscous fluid causes an imperfect heat exchanging between the viscous fluid in the small annular gap and the heat exchanging fluid in the heat receiving chamber, and thus, a heat exchanging efficiency between the heat-generating chamber and the heat receiving chamber is reduced. Therefore, degradation in the heat-generating performance of the viscous fluid might easily occur.

Further, as the rotor element of the above-describe d viscous fluid type heat generating apparatus is provided with a plurality of elements, i.e., the pair of axially spaced fixing plates and the cylindrical outer peripheral member which must be assembled together before the rotor element is mounted on the drive shaft and incorporated into the heat generating apparatus, the manufacturing cost of the rotor element must necessarily increase.

SUMMARY OF THE INVENTION

Therefore, an object of the present invention is to provide a viscous fluid type heat generating apparatus, which is able to obviate the above-mentioned problems of the conventional viscous fluid type heat generating apparatus.

Another object of the present invention is to provide a viscous fluid type heat generating apparatus which is able to exhibit a desired heat-generating performance irrespective of a change in the rotating speed of a drive shaft when driven by a vehicle engine and to prevent degradation of the heat-generating performance of the viscous fluid.

A further object of the present invention is to provide a viscous fluid type heat generating apparatus capable of being manufactured at a reduced manufacturing cost.

In accordance with the present invention, there is provided a viscous fluid type heat generating apparatus which comprises:

a housing defining a heat-generating chamber having a wall surface thereof, and a heat receiving chamber arranged adjacent to the heat-generating chamber and permitting a heat exchanging fluid to flow therethrough;

a drive shaft rotatably supported by a bearing means housed in the housing and having an axis of rotation thereof;

a rotor element arranged in the heat-generating chamber to be driven for rotation about an axis thereof by said drive shaft and having an outer face; and a viscous fluid held in at least a fluid-holding gap defined between the wall surface of the heat-generating chamber and the outer face of the rotor element to generate heat in response to an application of a shearing action thereto during the rotation of the rotor element;

wherein the rotor element has a base portion mounted on the drive shaft and a tubular portion integral with the base portion and extending coaxially with the axis of rotation of the drive shaft, the tubular portion having a substantially cylindrical outer face constituting a main part of the outer face of the rotor element, which cooperates with said wall surface of the heat-generating chamber to define a primary part of the fluid-holding gap, wherein the tubular portion of said rotor element provides therein a storing chamber for storing the viscous fluid while avoiding application of the shearing action from the rotor element to the viscous fluid, wherein the viscous fluid type heat generating apparatus further comprises:

a fluid circulating means for permitting a circulatory movement of the viscous fluid through the storing chamber and the fluid-holding gap via an open end of the tubular portion of the rotor element during the rotation of the rotor element; and a flow rate controlling means arranged adjacent to the open end of the tubular portion of said rotor element for adjustably changing an amount of flow of the viscous fluid circulated by the fluid circulating means.

Preferably, the base portion of the rotor element has a cylindrical outer face continuous with the substantially cylindrical outer face of the tubular portion and defining a secondary part of the outer face of the rotor element.

At least the cylindrical outer face of the tubular portion of the rotor element may be formed as either an axially straight or an axially tapered cylindrical outer face.

The above-mentioned flow rate controlling means is able to adjustably change an amount of the viscous fluid, which flows through the fluid-holding gap, the fluid circulating means, and the fluid storing chamber, irrespective of the rotating speed of the drive shaft. Therefore, the viscous fluid held in the fluid-holding gap can be constantly subjected to a suitable shearing action to satisfy both generation of heat necessary to be supplied to an external heating system such as a vehicle heating system and prevention of thermal and physical degradation in the heat-generating property of the viscous fluid per se.

The rotor element having the integrally formed base and tubular portions can contribute to a reduction in the number of parts required for constructing the rotor element, and accordingly, assembling of the rotor element can be simplified to result in a reduction in the manufacturing and assembling cost of the rotor element. Further, the substantially cylindrical outer face of the tubular portion of the rotor element which is formed as an either an axially straight or a tapered cylindrical outer face, can cooperate with the inner wall surface of the heat-generating chamber so as to form a primary part of the fluid-holding gap as an axially straight or axially tapered cylindrical gap having a large surface area to hold the viscous fluid thereon while preventing the axial length and the outer diameter of the fluid-holding gap from being largely increased. Therefore, the whole size of the viscous fluid type heat generating apparatus may be reduced to allow the apparatus to be mounted even in a narrow mounting area in a vehicle.

The fluid circulating means may include an intercommunicating passage which is arranged to provide a fluid communication between the fluid-holding gap and the storing chamber at a position adjacent to the open end of the tubular portion of the rotor element. Thus, the intercommunicating passage may be formed either in the open end of the tubular portion of the rotor element or in a portion of the housing confronting the open end of the tubular portion of the rotor element. The intercommunicating passage allows the viscous fluid to be supplied from the storing chamber inside the rotor element to the fluid-holding gap between the rotor element and the inner wall of the heat-generating chamber, due to a centrifugal force acting on the fluid in the storing region during the rotation of the rotor element. Then, the viscous fluid held in the fluid-holding gap is in turn pumped out of the gap into the storing chamber through a fluid returning passage arranged at a position axially opposite to the intercommunicating passage, due to a fluid pressure provided by the viscous fluid supplied from the storing chamber. The viscous fluid in the fluid-holding gap is also pumped out of there, due to a thermal expansion of the viscous fluid per se during the generation of heat.

Preferably, the flow rate controlling means may include a valve means arranged so as to be able to adjustably change an amount of a cross-sectional area of path of the intercommunicating passage. More specifically, the flow rate controlling means may be embodied in such a manner that when the tubular portion of the rotor element has an outermost open end lying in a plane perpendicular to the axis of rotation of the drive shaft and when the heat-generating chamber has a part of the inner wall confronting the outermost open end of the rotor element and defining a small fluid-holding gap in which the viscous fluid may generate heat in response to the rotation of the rotor element, the intercommunicating passage is formed so that it may be able to increase and decrease the small fluid-holding gap provided between the outermost open end of the rotor element and the part of the inner wall of the heat-generating chamber by the operation of the valve means. To this end, the valve means may be preferably provided in the housing, and may be constituted by a solenoid-operated valve means capable of being operated by a control signal provided from outside the heat generating apparatus. Then, the amount of flow of the viscous fluid circulating through the storing chamber, the intercommunicating passage, the fluid-holding gap, and the fluid-returning passage can be easily and finely controlled by the operation of the solenoid-operated control valve in response to a change in the number of rotation of the drive shaft. The control signal controlling the solenoid-operated valve means may be one of the signals produced in relation to the number of rotation of the drive shaft, a change in the temperature of the viscous fluid in the fluid-holding gap, and a change in the temperature of the circulating viscous fluid.

The valve means may be provided at either a portion of the outermost open end of the rotor element or a portion of the drive shaft, which radially confronts the outermost open end of the rotor element. The valve means provided in the above-mentioned portion of the drive shaft may preferably be a centrifugally-operated valve element mounted on the drive shaft to be able to move toward an opening of the intercommunicating passage against a constant spring force, in response to a change in the rotating speed of the drive shaft. Then, the valve element can control the amount of flow of the viscous fluid circulating through the heat-generating gap and the storing chamber in response to the change in the rotating speed of the drive shaft. The provision of the valve means on a position adjacent to the outermost open end of the rotor element facilitates mounting and assembling of the valve means in the heat generating apparatus to thereby allow a reduction in the manufacturing cost of the apparatus.

The rotor element may have a pair of axially opposite end faces lying in respective planes perpendicular to the axis of rotation of the drive shaft, and the heat-generating chamber may have a pair of axially confronting inner wall faces which confront the pair of opposite end faces of the rotor element, respectively, to define a pair of small annularly extending disc-like fluid-holding gaps. The pair of annularly extending disc-like fluid-holding gaps may be a secondary part of the fluid-holding gap. As a result, the viscous fluid held in the aforementioned primary part and that held in the above secondary part of the fluid-holding gap cooperate with one another to effectively generate heat in response to the rotation of the rotor element within the heat-generating chamber. Then, the fluid circulating means may include a first group of spirally arranged radial grooves formed in at least one of the pair of axially opposite end faces of the rotor element, which can function to promote the circulatory movement of the viscous fluid through the storing chamber and the fluid-holding gap. The first group of spirally arranged radial grooves are able to increase an amount of the circulation of the viscous fluid in response to an increase in the rotating speed of the rotor element within the heat-generating chamber. Further, the flow rate controlling means may include a second group of spirally arranged radial grooves formed in at least one of the pair of axially opposite end faces of the rotor element, which can function to discourage the circulatory movement of the viscous fluid through the storing chamber and the fluid-holding gap in response to the rotation of the rotor element. The second group of spirally arranged radial grooves will act so as to reduce an amount of circulating flow of the viscous fluid in response to an increase in the rotating speed of the rotor element.

BRIEF DESCRIPTION OF THE DRAWINGS

The above and other objects, features and advantages of the present invention will be made more apparent from the ensuing description of the preferred embodiments thereof, with reference to the accompanying drawings wherein.

DESCRIPTION OF THE PREFERRED EMBODIMENTS

(The First Embodiment)

Figure 1A:
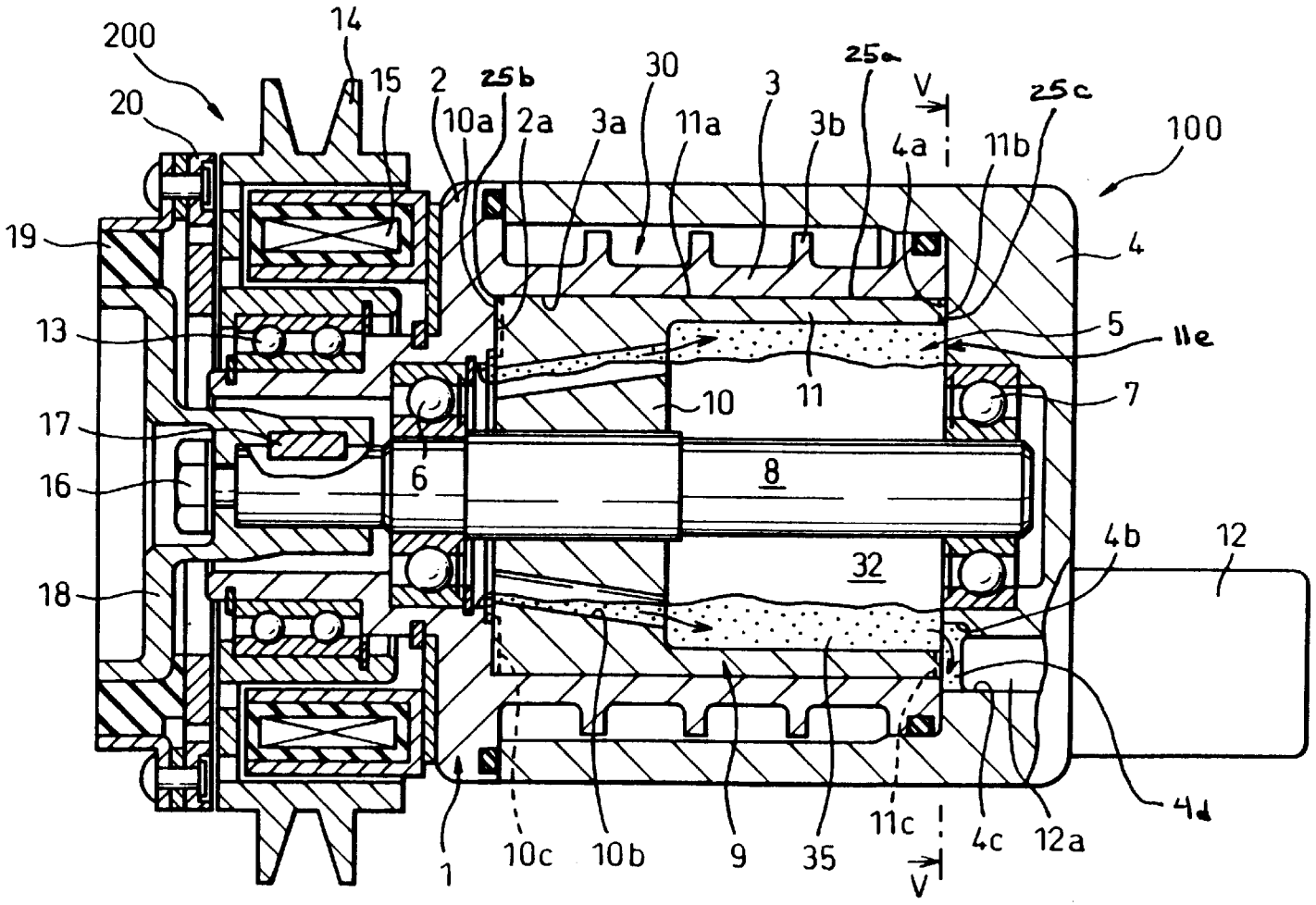
FIG. 1A is a longitudinal cross-sectional view of a viscous fluid type heat generating apparatus according to a first embodiment of the present invention, illustrating a state where a drive shaft is rotated at a low speed.
Figure 2:
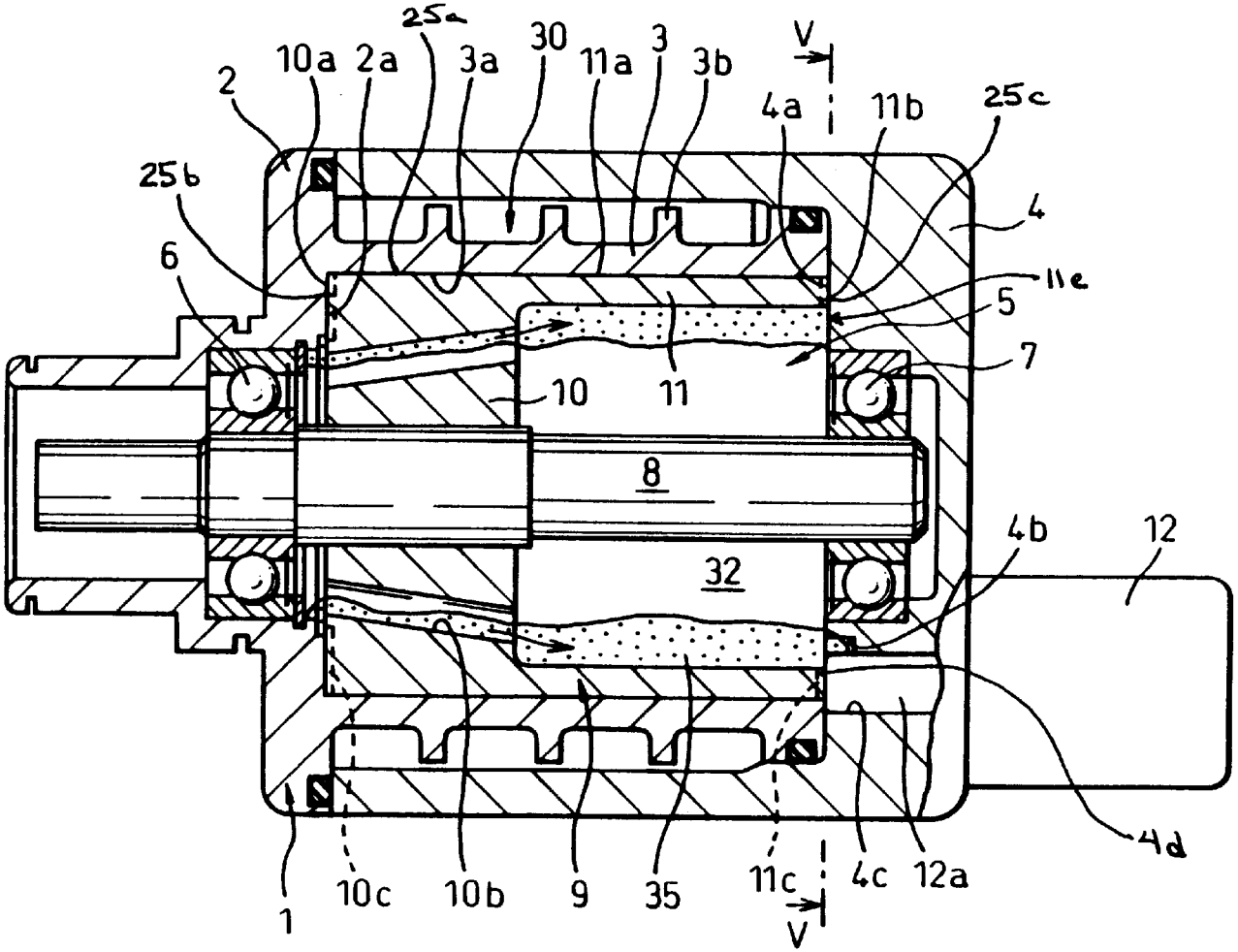
FIG. 2 is the same view of the apparatus of FIG. 1A, illustrating a state where the drive shaft is rotated at a high speed.

Referring to FIGS. 1A and 2, a viscous fluid type heat generating apparatus 100 of a first embodiment of the present invention includes a front housing 1 having a flange 2 and a cylindrical portion 3 extending axially rear wardly from an end face of the flange 2. The cylindrical portion 3 has an inner cylindrical wall surface 3*a*. The cylindrical portion 3 of the front housing 1 is housed by a cup-like rear housing 4 having a front end connected to a rear end face of the flange 2 of the front housing via an O-ring. An O-ring is also arranged between an outer end of the cylindrical portion 3 of the front housing 1 and an innermost end portion of the rear housing 4. The outer end of the cylindrical portion 3 of the front housing 1 abuts on an innermost cylindrical end face 4*a* of the rear housing 4, so that the inner cylindrical wall 3*a* of the cylindrical portion 3 of the front housing 1 and the innermost cylindrical end face of the rear housing 4 cooperate to form a closed cavity 5 which will be hereinafter referred to as a heat-generating chamber 5. Further, the rear end of the flange 2 and an outer cylindrical face of the cylindrical portion 3 cooperate with an inner wall of a cylindrical portion of the rear housing 4 to form a generally annular water jacket region 30 which will be hereinafter referred to as a heat receiving chamber 30.

The heat-generating chamber 5 is filled with a viscous fluid 35 such as silicone oil, together with a limited amount of air. The heat receiving chamber 30 is provided with a liquid inlet and a liquid outlet (not shown in FIGS. 1A and 2) so that a heat exchanging liquid is circulated through the heat receiving chamber 30. The liquid inlet and outlet are fluidly connected to an external liquid conduit for a vehicle heat system. Thus, the heat exchanging water carries heat from the viscous fluid type heat generating apparatus 100 to the vehicle heating system. The cylindrical portion 3 is provided with a plurality of radial fins 3*b* formed in the outer surface so as to project into the heat receiving chamber 30 for the purpose of increasing a heat exchanging efficiency.

The front housing 1 supports a bearing device 6 having a shaft seal arranged at one end thereof closer to the heat-generating chamber 5, and the rear housing 4 supports a bearing device 7 having a shaft seal arranged at one end thereof confronting the heat-generating chamber 5. The bearing devices 6 and 7 are axially spaced from one another and rotatably support a drive shaft 8. A rotor element 9 having the shape of a cup is fixedly mounted on the drive shaft 8 so that it is rotated by the drive shaft 8 within the heat-generating chamber 5. The rotor element 9 includes a base portion 10 press-fitted on the drive shaft 8 and a tubular portion 11 formed integrally with the base portion 10. The tubular portion 11 of the rotor element 9 extends axially and rearwardly from the base portion 10 to form an open rear end 11*e*. The base portion 10 has an outer end face 10*a* at its frontmost end adjacent to the rear end face of the flange 2 of the front housing 1, and the tubular portion 11 of the rotor element 9 has an outer cylindrical face 11*a* radially facing the inner cylindrical wall surface 3*a* of the front housing 1.

Figure 1B:
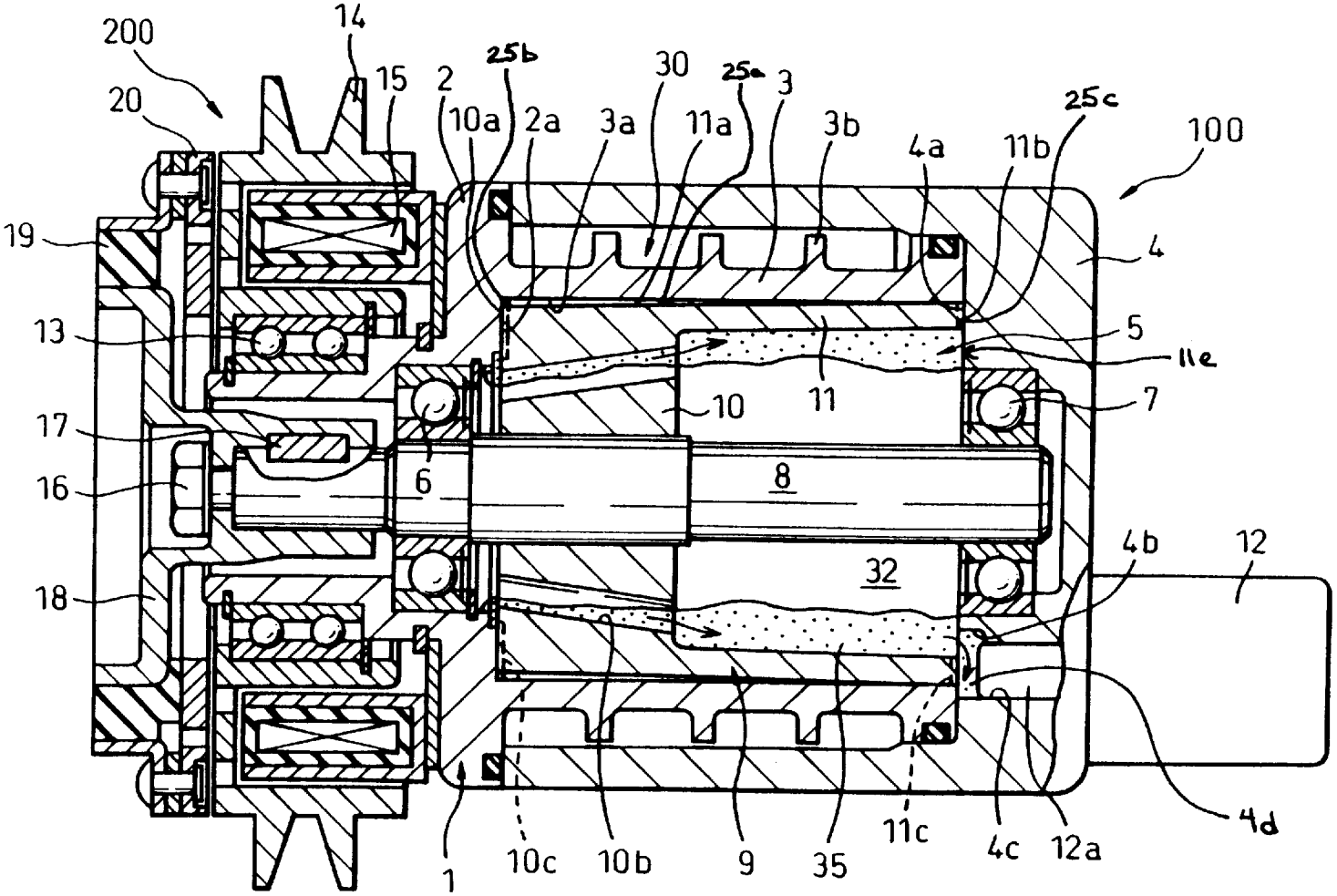
FIG. 1B is a longitudinal cross-sectional view of a viscous fluid type heat generating apparatus, illustrating a modification in which the rotor element has an axially tapered cylindrical outer face.

The outer cylindrical face 11*a* of the tubular portion 11 may be formed as an axially tapered cylindrical face as shown in FIG. 1B, to promote a circularation of the viscous fluid through a gap between the axially tapered cylindrical face 11*a* and the inner cylindrical wall surface 3*a* of the cylindrical portion 3 of the front housing 1 as required.

The outer cylindrical face 11*a* of the tubular portion is substantially continuous with an outer cylindrical wall of the base portion 10 of the rotor element 9. The tubular portion 11 of the rotor element 9 also has an outermost end face 11*b* surrounding the open rear end 11*e* of the portion 11 and annularly extending around the axis of rotation of the drive shaft 8. The outermost end face 11*b* of the rotor element 9 confronts the innermost cylindrical end face 4*a* of the rear housing 4.

The flange 2 of the front housing 1 has an inner face 2*a* formed to axially confront the outer end face 10*a* of the rotor element 9. Therefore, the outer cylindrical face 11*a* of the tubular portion 11 and the base portion 10 of the rotor element 9, and the cylindrical wall surface 3*a* of the cylindrical portion 3 of the front housing 1 cooperate to produce therebetween a small gap extending cylindrically to be used as a cylindrical fluid-holding gap 25*a* or a heat-generating gap in which the viscous fluid generates heat when it is subjected to a shearing action due to the rotation of the rotor element 9. Further, a combination of the outer end face 10*a* of the base portion 10 and the inner face 2*a* of the flange 2, and a different combination of the outermost end face 11*b* of the tubular portion 11 and the innermost cylindrical end face 4*a* of the rear housing 4 define front and rear small annular gaps 25*b*,25*c* capable of acting as additional heat-generating gaps on the axially opposite sides of the rotor element 9.

The tubular portion 11 of the rotor element 9 provides an inner cavity within the heat-generating chamber 5, to be used as a storing chamber 32 for storing the viscous fluid without being subjected to a shearing action by the rotor element 9 during the rotation of the rotor element 9.

Figure 3:
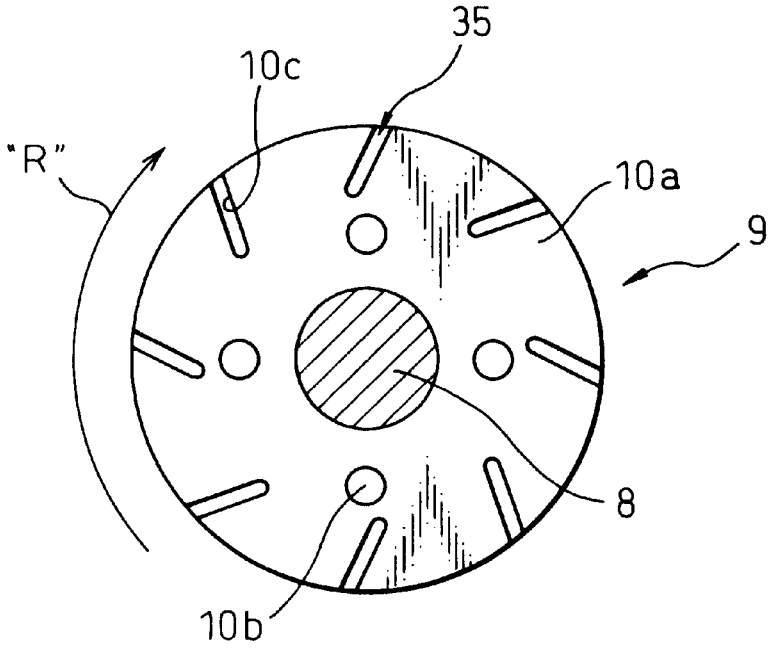
FIG. 3 is a schematic front view of a rotor element and a drive shaft of the heat generating apparatus of FIG. 1A.
Figure 4:
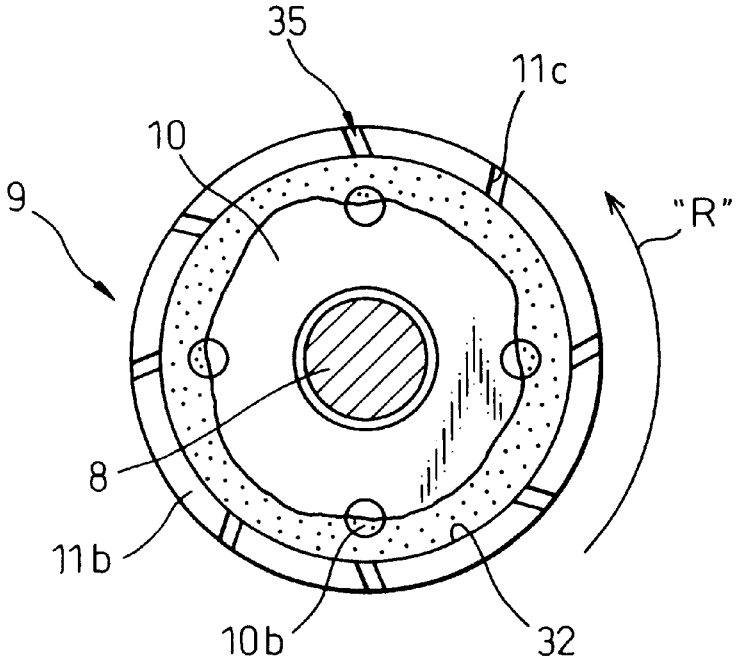
FIG. 4 is a schematic rear view of the rotor element and the drive shaft of the heat generating apparatus of FIG. 1A.

The base portion 10 of the rotor element 9 is provided with at least one fluid returning passage 10*b* (e.g., five fluid returning passages in the first embodiment of FIGS. 3 and 4) formed therein to provide a fluid communication between the fluid-holding gaps and the storing chamber 32. The fluid returning passage 10*b* has the shape of an inclined through bore extending axially and ascending from the outer end face 10*a* to an innermost end face of the storing chamber 32. The fluid returning passage or passages 10*b* are provided for returning the viscous fluid from the fluid-holding gaps to the fluid storing chamber 32. Namely, the fluid returning passage 10*b* forms a part of a fluid circulating means in the heat generating apparatus.

Figure 5:
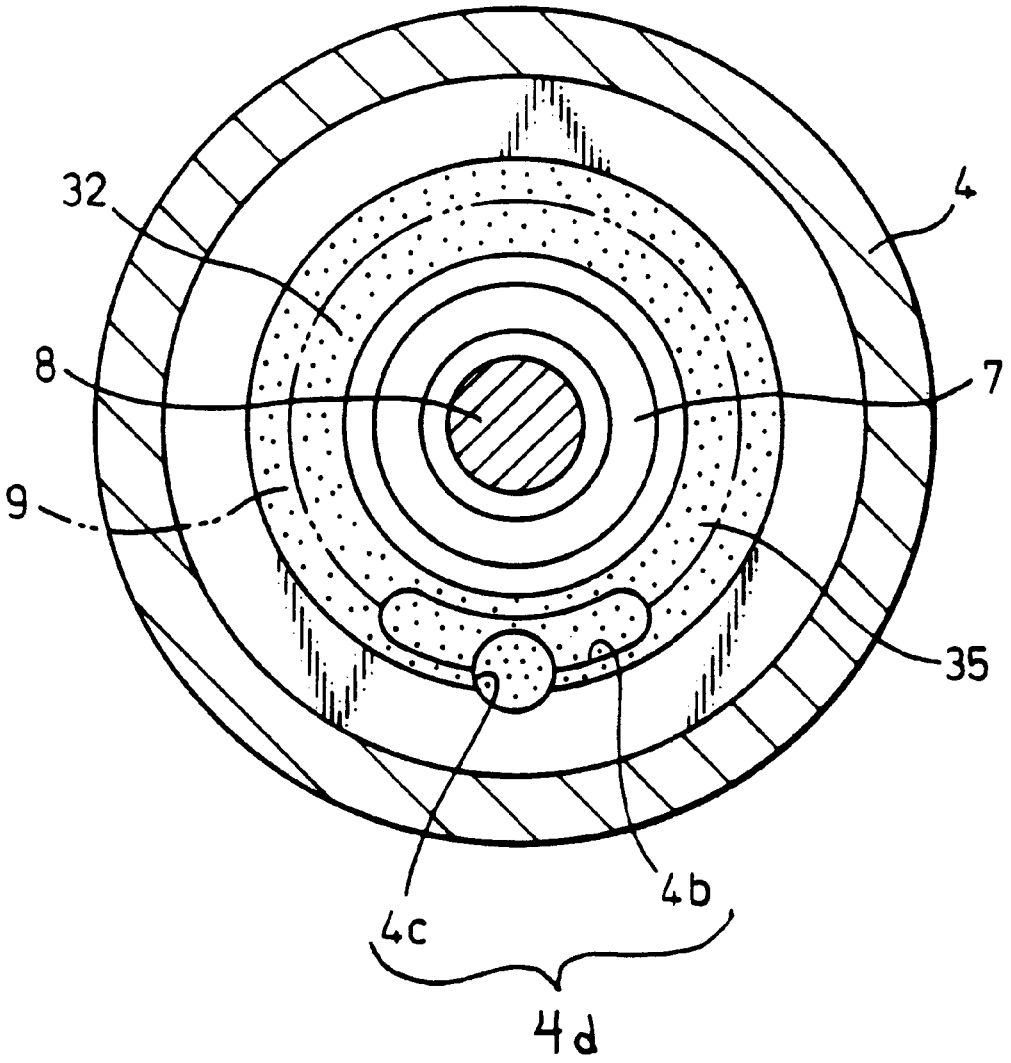
FIG. 5 is a cross-sectional view taken along the line V—V of FIGS. 1A and 2.

The rear housing 4 is provided with an arcuate recess 4*b* formed in a part of the innermost cylindrical end face 4*a* thereof, i.e., a lower part of the innermost end face 4*a*, at a position facing the open end of the rotor element 9, and an axial bore 4*c* connected to a lower part of the arcuate recess 4*b*. The axial bore 4*c* is formed as an axial through bore extending from the recess 4*b* toward an outer rear face of the rear housing 4. The arcuate recess 4*b* and the bore 4*c* of the rear housing 4 form a passage 4*d* and are arranged to provide a fluid communication between the storing chamber 32 and the cylindrical fluid-holding gap (the heat-generating gap) between the outer cylindrical face 11*a* and the inner wall 3*a* of the cylindrical portion 3, and also to form a further part of the fluid circulating means in the heat generating apparatus 100. The arrangement and the shape of the arcuate recess 4*b* and the bore 4*c* of the rear housing 4 are best shown in FIG. 5.

As best shown in FIG. 3, the outer end face 10*a* of the base portion 10 of the rotor element 9 is provided with a plurality of spirally arranged radial grooves 10*c* formed therein which act so as to introduce the viscous fluid (the silicone oil) 35 from the cylindrical fluid-holding gap toward a radially inner region of the cylindrical fluid-holding gap between the outer end face 10*a* and the outer end face 2*a* of the flange 2 in response to the rotation of the rotor element in a direction indicated by "R". The spirally arranged radial grooves 10*c* form a still further part of the fluid circulating passage means in the heat generating apparatus 100.

The heat generating apparatus 100 is provided with a solenoid-operated actuator 12 attached to the outer end face of the rear housing 4 as shown in FIG. 1. The solenoid-operated actuator 12 includes therein a solenoid (not shown) which is energized or de-energized (by an externally applied signal. The actuator 12 has a movable rod 12*a* capable of moving forward and back in response to the energizing and de-energizing of the solenoid. The movable rod 12*a* slidably fitted in the through bore 4*c* acts as a valve element which operates so as to adjustably change an amount of flow of the viscous fluid 35 which flows through the arcuate recess 4*b* and the bore 4*c*. Namely, the rod 12*a* of the actuator 12 functions as an important part of a flow rate controlling means incorporated in the heat generating apparatus 100. The solenoid of the actuator 12 is electrically connected to an external electro-control unit ECU (not shown in FIG. 1) which is connected to a thermo-sensor for detecting a temperature of the heat exchanging fluid (the cooling water of the vehicle) flowing through the heating system, and to a rotation detector detecting the rotating speed of the vehicle engine.

As shown in FIG. 4, the outermost end face 11*b* of the tubular portion 11 of the rotor element 9 is provided with a plurality of spirally arranged radial grooves 11*c* for introducing the viscous fluid 35 from the cylindrical fluid-holding or heat-generating gap toward the storing chamber 32 in response to the rotation of the rotor element 9 in the direction indicated by "R". The radial grooves 11*c* of the tubular portion 11 of the rotor element 9 act so as to discourage the flow of circulation of the viscous fluid within the heat generating apparatus, and can function as a part of the flow rate controlling means.

A solenoid clutch 200 is mounted on the front housing 1 and the drive shaft 8. The solenoid clutch 200 includes a pulley 14 rotatably mounted on a front boss portion of the front housing 1 via a bearing device 13, and a solenoid 15 arranged inside the pulley 14 and electrically connected to the aforementioned electro-control unit ECU. The solenoid clutch 200 further includes a hub element 18 fixedly mounted on the drive shaft 8 by screw bolts 16 and a key 17, and an armature 20 of the solenoid 15 which is connected to the hub element 18 via an elastic element 19 made of rubber material. Thus, when the viscous fluid type heat generating apparatus 100 is mounted on a vehicle, it is arranged in an engine compartment so that the axis of the drive shaft 8 of the heat generating apparatus 100 is parallel with a crankshaft of the vehicle engine to receive a drive power from the vehicle engine via a transmitting belt (not shown in FIGS. 1A and 2) and the pulley 14.

In the above-described viscous fluid type heat generating apparatus 100, when the drive shaft 8 is rotationally driven by the vehicle engine via the solenoid clutch 200, the rotor element 9 is rotated together with the drive shaft 8 within the heat-generating chamber 5. Thus, the viscous fluid (the silicone oil) 35 held in the cylindrical fluid-holding gap 25*a* between the cylindrical inner wall surface 3*a* of the cylindrical portion 3 of the front housing 1 and the outer cylindrical face 11*a* of the rotor element 9 and the viscous fluid held in the annular fluid-holding gaps 25*b*,25*c* arranged at the opposite outer ends 10*a* and 11*b* of the rotor element 9 are subjected to a shearing action by the rotation of the rotor element 9 to generate heat. The heat generated by the viscous fluid 35 is transmitted to the heat exchanging liquid (e.g., the cooling water of the vehicle engine) flowing through the heat receiving chamber 30 and carried by the heat exchanging liquid to the vehicle heating system for heating an objective heated area, i.e., a passenger compartment.

As shown in FIG. 1A, when the vehicle is driven at a low speed, the drive shaft 8 of the heat generating apparatus 100 is rotated at a low speed to rotate the rotor element 9 at the same low speed. Therefore, a small centrifugal force acts on the silicone oil 35 in the fluid passages 10*b*.

Further, during the rotation of the rotor element 9 at a low speed in the direction "R", the spirally arranged radial grooves 10*c* of the rotor element 9 act so as to introduce a relatively small amount of silicone oil 35 from the cylindrical fluid-holding gap around the rotor element 9 toward the radially inner region of the outer end face 10*a* of the rotor element 9 against the small centrifugal force. Further, when the solenoid-operated actuator 12 is energized to withdraw the rod 12*a* (the valve means) into the body of the actuator 12 via the axial bore 4*c*, the cross-sectional area of path of the arcuate recess 4*b* and the axial bore 4*c* in the rear housing 4 is increased so as to permit a relatively large amount of silicone oil 35 to flow therethrough.

The spirally arranged grooves 11*c* of the tubular portion 11 of the rotor element 9 act so as to introduce a relatively small amount of the silicone oil 35 from the cylindrical fluid-holding gap around the rotor element 9 into the storing region in response to the low speed rotation of the rotor element 9 in the direction "R" against the small centrifugal force acting on the silicone oil 35. As a result, a flow of the silicone oil 35 from the storing chamber 32 toward the cylindrical fluid-holding gap around the rotor element 9 generally occurs, via the open end 11*e* of the tubular portion 11 of the rotor element 9 and the arcuate recess 4*b* of the rear housing 4. Namely, a supply of the silicone oil 35 from the storing chamber 32 into the cylindrical fluid-holding gap (the heat-generating gap) through the arcuate recess 4*b* occurs in the heat generating apparatus 100. When the silicone oil 35 is supplied from the storing chamber 32 toward the cylindrical fluid-holding gap, the silicone oil 35 held in the fluid-holding gas in advance is pressed by the silicone oil 35 supplied from the storing chamber 32 while being thermally expanded within the fluid-holding gap due to the heat generation. Therefore, the silicone oil 35 in the cylindrical fluid-holding gap is gradually moved toward the front part of the cylindrical fluid-holding gap and is eventually moved back to the storing chamber 32 via the spirally arranged radial grooves 10*c* and the fluid passages 10*b* of the base portion 10 of the rotor element 9. Accordingly, during the rotation of the rotor element 9 at a low speed, a circulation of the silicone oil 35 (the viscous fluid) constantly occurs through the cylindrical and annular fluid-holding gaps and the storing chamber 32. It should be understood that the silicone oil 35 in the cylindrical and front and rear annular fluid-holding gaps generates heat due to the shearing action applied to the viscous silicone oil 35 from the rotating rotor element 9. The heat generated by the silicone oil 35 is transmitted to the heat exchanging liquid flowing through the heat-receiving chamber 30. Therefore, the heat generating apparatus preventing 100 can appropriately exhibit a heat-generating performance while the silicone oil 35 is prevented from being degraded thermally and physically.

As shown in FIG. 2, when the vehicle is driven at a high speed, and when the drive shaft 8 is rotated by the vehicle engine at a high speed while rotating the rotor element 9 at the same high speed, the silicone oil 35 in the fluid passages 10*b* of the base portion 10 of the rotor element 9 is subjected to a relatively large centrifugal force. Further, the spirally arranged grooves 10*c* in the outer end face 10*a* of the rotor element 9 rotating at a high speed in the direction "R" cause the silicone oil 35 in the cylindrical fluid-holding gap to actively flow into the radially inner region of the outer end face 10*a* of the base portion 10 of the rotor element 9 against a centrifugal force acting thereon.

When the drive shaft 8 and the rotor element 9 are rotated at a high speed, the solenoid of the actuator 12 is de-energized to extend the rod (the valve element) 12*a* frontward in the axial bore 4*c*. Thus, the cross-sectional area of path of the recess 4*b* and the axial bore 4*c* of the rear housing 4 is reduced by the extended rod 12*a*, and accordingly, an amount of flow of the silicone oil 35 passing through the recess 4*b* and the axial bore 4*c* is reduced.

The spirally arranged radial grooves 11*c* of the outermost end face 11*b* of the rotor element 9 causes an active flow of the silicone oil 35 from the cylindrical fluid-holding gap into the storing chamber 32, due to a high speed rotation of the rotor element 9. Accordingly, the silicone oil 35 in the storing chamber 32 is not actively moved from the storing chamber 32 into the fluid-holding gaps even though a relatively large centrifugal force acts on the silicone oil 35 in the storing chamber 32 during the high speed rotation of the rotor element 9. Consequently, an active supply of the silicone oil 35 from the storing chamber 32 to the cylindrical fluid-holding gap (the heat-generating gap) via the open end of the tubular portion 11 of the rotor element 9 is prevented, and a relatively small amount of supply of the silicone oil 35 from the storing chamber 32 into the cylindrical fluid-holding gap occurs. Thus, when the rotor element 9 is rotated at a high speed, the silicone oil 35 held in the cylindrical fluid-holding gap is moved therefrom toward the storing chamber 32, via the spirally arranged grooves 10*c* and the fluid returning passage 10*b* of the rotor element 9 due to a thermal expansion of the silicone oil 35 per se within the cylindrical and annular fluid-holding gaps and due to a relatively small pressure provided by the silicone oil 35 supplied from the storing chamber 32. As a result, a circulation of the silicone oil 35 through the cylindrical and annular fluid-holding gaps and the storing chamber 32 is performed to prevent degradation in the heat-generating performance of the silicone oil 35, even during the high speed rotation of the rotor element 9.

It should be understood that during the high speed rotation of the rotor element 9, the amount of the silicone oil 35 held in the fluid-holding gaps is kept small but it is held there for a relatively long time. Thus, the heat generated in the fluid-holding gaps is effectively transmitted to the heat exchanging liquid in the heat-receiving chamber 30. Therefore, the silicone oil 35 in the fluid-holding gaps can generate a desired amount of heat due to the application of an appropriate shearing action by the rotating rotor element 9 without being degraded in the heat-generating performance even when the rotor element 9 is rotated at a high speed.

In accordance with the construction of the viscous fluid type heat generating apparatus 100, the rotor element 9 is integrally formed by the base portion 10 and the tubular portion 11. Therefore, the rotor element 9 can be a single element, and accordingly, the manufacturing and assembling cost of the rotor element 9 can be kept low to result in a reduction in the manufacturing and assembling cost of an entire assembly of the viscous fluid type heat generating apparatus. Further, since the tubular portion 11 of the rotor element 9 forms a cylindrical fluid-holding gap (a heat-generating gap), the entire size of the viscous fluid type heat generating apparatus can be smaller than that of the conventional heat generating apparatus incorporating therein a rotor element forming a circular disc-like heat generating gap. Thus, the viscous fluid type heat generating apparatus of the present invention can be easily mounted in an engine compartment of a vehicle.

Further, according to the first embodiment of the present invention, the viscous fluid type heat generating apparatus 100, the solenoid-operated actuator 12 controlled by an externally-applied control signal is attached to the rear housing 4, and is used for controlling the amount of circulation of the viscous fluid (the silicone oil) in response to a change in the rotating speed of the rotor element 9. Therefore, a fine control of the amount of circulation of the silicone oil 35 can be achieved in response to a change in the rotating speed of the rotor element 9. Thus, degradation in the heat generating performance of the silicone oil can be effectively prevented.

In the first embodiment of the present invention, the viscous fluid type heat generating apparatus 100 is constructed to be driven by the vehicle engine via the solenoid clutch 200. Nevertheless, the solenoid clutch 200 may be omitted so that a vehicle engine directly drives the drive shaft 8 of the heat generating apparatus 100 via the pulley 14.

(The Second Embodiment)

Figure 6:
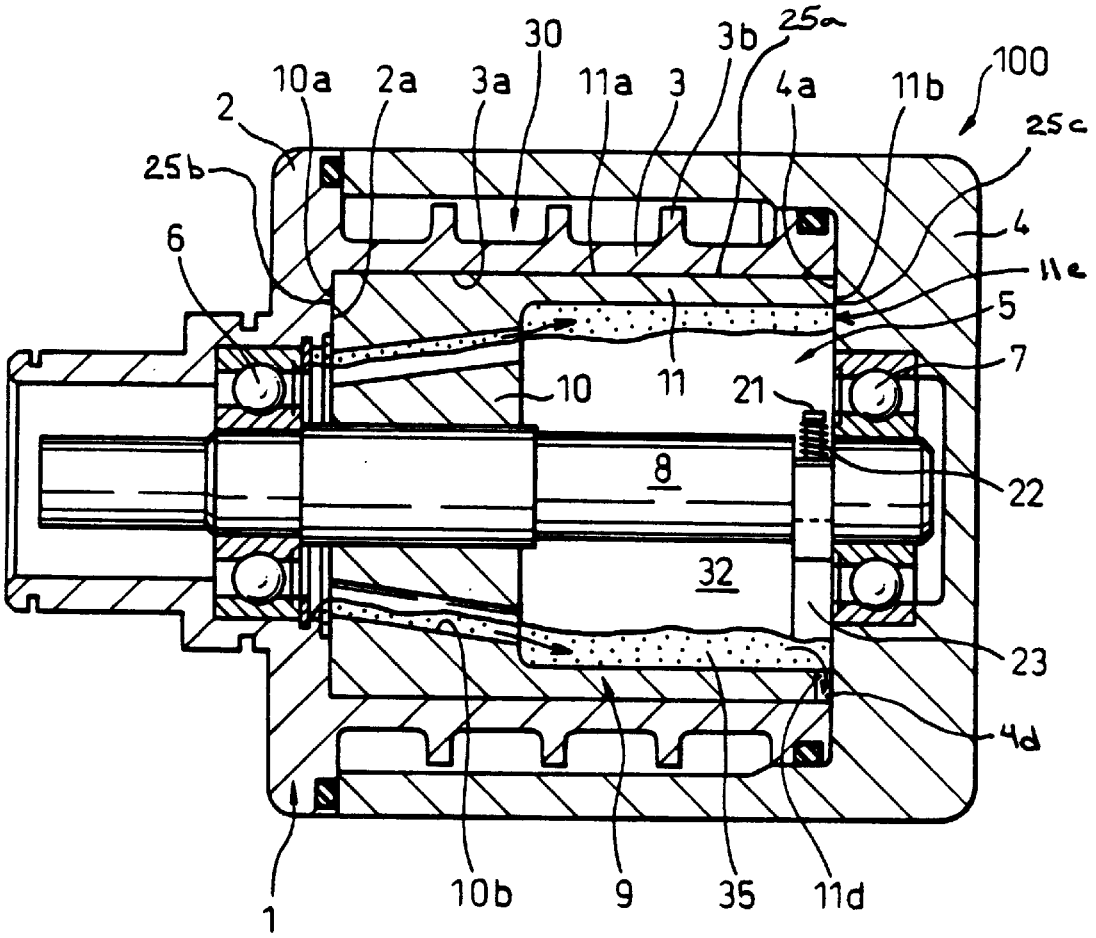
FIG. 6 is a longitudinal cross-sectional view of a viscous fluid type heat generating apparatus according to a second embodiment of the present invention, illustrating a state where a drive shaft is rotated at a high speed.

FIG. 6 illustrates a viscous fluid type heat generating apparatus according to a second embodiment of the present invention. However, the same reference numerals as those used with the first embodiment designate the same or like elements or portions of the heat generating apparatus.

Figure 7:
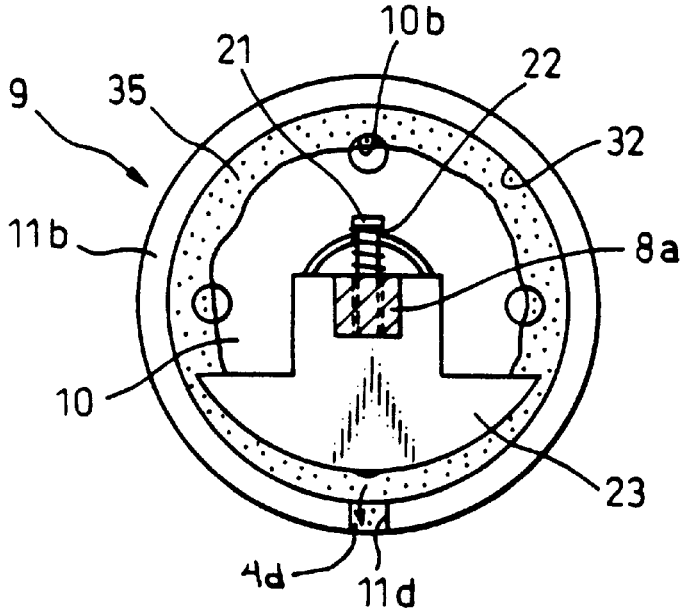
FIG. 7 is a schematic cross-sectional view of a rear part of a rotor element of the heat generating apparatus of FIG. 6, illustrating an arrangement of a valve means incorporated in the apparatus in the state where the rotor element is rotated at a low speed.
Figure 8:
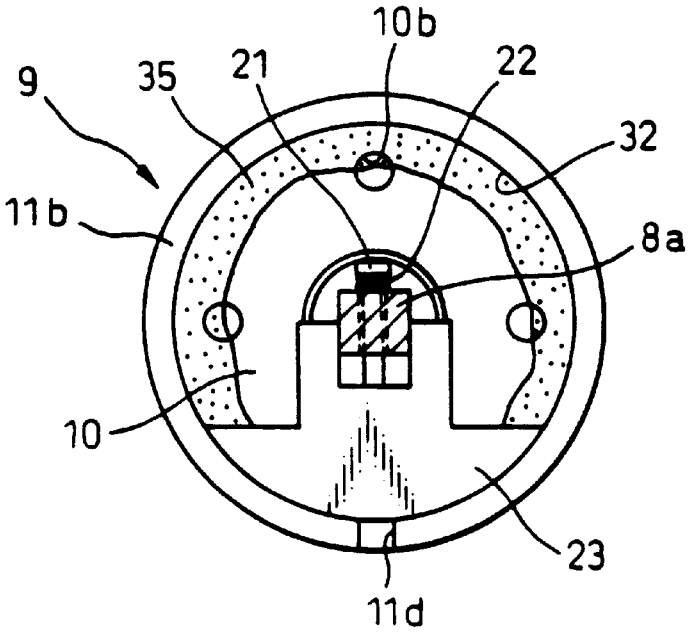
FIG. 8 is the same cross-sectional view as FIG. 7, illustrating the valve means in the state where the rotor element is rotated at a high speed.

Referring to FIG. 6, the viscous fluid type heat generating apparatus of the second embodiment is constructed in such a manner that a valve means is mounted on an end of the drive shaft 8 and arranged at a position adjacent to the open end of the tubular portion 11 of the rotor element 9. As best shown in FIGS. 7 and 8, the drive shaft 8 is provided with a guide face portion 8*a* at an end position adjacent to the rear bearing device 7 so as to have a rectangular cross-sectional shape. Further, a guide pin 21 is radially slidably fitted in the center of the guide face portion 8*a* of the drive shaft 8, and the guide pin 21 is constantly urged by a spring 22 in a direction moving out of the guide face portion 8*a*. Thus, the spring 22, which is a compression spring, is disposed between a head of the guide pin 21 and the guide face portion 8*a*. The guide pin 21 has a lower end opposite to the above-mentioned head, and the lower end of the guide pin 21 is attached to a valve element 23 functioning as a flow rate controlling means or a flow rate controlling valve. The valve element 23 is formed as a single element having a lower circular periphery and a central columnar portion provided with a recessed portion which is slidably fitted on the guide face portion 8*a* of the drive shaft 8. Thus, the valve element 23 can move up and down with respect to the guide face portion 8*a* of the drive shaft 8 in response to the movement of the guide pin 21.

In the viscous fluid type heat generating apparatus 100 of the second embodiment, the outer end face 10*a* and the outermost end face 11*b* of the rotor element 9 are not provided with any spirally arranged radial grooves 10*c* and 11*c* which are provided for the first embodiment. However, the tubular portion 11 of the rotor element 9 is provided with a groove 11*d* recessed in the outermost end face 11*b* of the tubular portion 11 so that an inner end of the groove 11*d* is covered or uncovered by the circular periphery of the valve element 23, in response to the movement of the valve element 23 toward and away from the groove 11*d*. The other outer end of the groove 11*d* is fluidly connected to the cylindrical fluid-holding gap (the heat-generating gap) between the rotor element 9 and the inner wall surface 3*a* of the front housing 1. Thus, the groove 11*d* of the rotor element 9 functions as a passage 4*d* providing a fluid communication between the cylindrical fluid-holding gap and the storing chamber 32 when it is not covered by the valve element 23. When the groove 11*d* of the rotor element 9 provides a large fluid communication between the cylindrical fluid-holding gap and the storing chamber 32, the groove 11*d* also functions as a passage permitting an active circulation of the silicone oil 35 through the fluid-holding gaps and the storing chamber 32. The remaining construction of the heat generating apparatus 100 of the second embodiment is the same as that of the apparatus of the first embodiment.

As shown in FIGS. 6 and 7, when the drive shaft 8 is rotated at a low speed to rotate the rotor element 9 at the same low speed, the silicone oil 35 in the fluid returning passage 10*b* and the groove 11*d* of the rotor element 9 is subjected to a relatively small centrifugal force due to the rotation of the rotor element 9. Further, the valve element 23 which is subjected to only a small centrifugal force, is urged to be moved away from the tubular portion 11 of the rotor element 9 due to the spring force of the spring 22, as shown in FIG. 7. Therefore, a large fluid communication channel is provided by the groove 11*d* between the storing chamber 32 and the cylindrical fluid holding gap 25*a* (the heat-generating gap) around the rotor element 9. Thus, an active supply of the silicone oil 35 from the storing chamber 32 into the cylindrical fluid-holding gap via the groove 11*d* of the open end of the rotor element 9 occurs, due to the action of the centrifugal force. Accordingly, a constant circulation of the silicone oil 35 through the storing chamber 32 and the cylindrical and annular fluid-holding gaps 25*b*,25*c* around the rotor element 9 occurs. Therefore, during the low speed rotation of the rotor element 9, a desirable amount of heat is generated by the silicone oil 35 held in the fluid-holding gaps, and a thermal and physical degradation in the heat-generating performance of the silicone oil 35 can be suitably prevented due to the constant circulation of the silicone oil 35. The heat generated in the fluid-holding gaps is transmitted to the heat exchanging liquid in the heat-receiving chamber 30.

On the other hand, when the drive shaft 8 and the rotor element 9 are rotated at a high speed, the silicone oil 35 in the fluid returning passage 10*b* and the groove 11*d* of the rotor element 9 is subjected to an appreciably large centrifugal force acting thereon. Further, the valve element 23 is centrifugally moved away from the guide face portion 8*a* of the drive shaft 8 toward the inside of the tubular portion 11 of the rotor element 9 against the spring force of the spring 22, as best shown in FIG. 8. Therefore, a fluid communication channel between the storing chamber 32 and the cylindrical fluid-holding gap via the groove 11*d* of the outermost end face 11*b* of the rotor element 9 is reduced. Therefore, an active supply of the silicone oil 35 from the storing chamber 32 into the cylindrical fluid-holding gap via the open end of the tubular portion 11 of the rotor element 9 does not occur irrespective of a large centrifugal force acting on the silicone oil 35 in the storing chamber 32. Nevertheless, a limited amount of supply of the silicone oil 35 from the storing chamber 32 into the cylindrical fluid-holding gap occurs so that an appropriate amount of circulation of the silicone oil 35 through the storing chamber 32 and the cylindrical and annular fluid-holding gaps occurs via the fluid returning passage 10*b*. Thus, a desired amount of heat generation and prevention of degradation in the heat-generating performance of the silicone oil 35 can be achieved even during the high speed rotation of the rotor element 9.

It should be understood that since the valve element 23 is easily attached to an end of the drive shaft 8, the assembly of the valve element 23, i.e., the flow rate controlling means can be very simple to result in a reduction in the manufacturing and assembling cost of the viscous fluid type heat generating apparatus.

From the foregoing description of the preferred embodiments of the present invention, it will be understood that, in accordance with the present invention, the viscous fluid type heat generating apparatus suitable for being incorporated in a vehicle heating system can constantly exhibit an appropriate heat-generating performance irrespective of the rotating speed of the drive shaft and the rotor element while preventing degradation in the heat-generating performance of the viscous fluid.

Many and various changes and modifications will occur to a person skilled in the art without departing from the scope and spirit of the present invention as claimed in the accompanying claims.

What we claim is:

1. A viscous fluid type heat generating apparatus comprising:

a housing defining a heat-generating chamber having a wall surface thereof, and a heat receiving chamber arranged adjacent to said heat-generating chamber, and permitting a heat exchanging fluid to flow therethrough;

a drive shaft rotatably supported by a bearing means housed in said housing and having an axis of rotation thereof;

a rotor element arranged in said heat-generating chamber to be driven for rotation about an axis thereof by said drive shaft and having an outer face; and a viscous fluid held in at least a fluid-holding gap defined between said wall surface of said heat-generating chamber and said outer face of said rotor element to generate heat in response to an application of a shearing action thereto during the rotation of said rotor element;

wherein said rotor element has a base portion mounted on said drive shaft and a tubular portion integral with said base portion and extending coaxially with the axis of rotation of said drive shaft, said tubular portion having a substantially cylindrical outer face constituting a main part of said outer face of said rotor element, which cooperates with said wall surface of said heat-generating chamber to define a primary part of said fluid-holding gap, wherein said tubular portion of said rotor-element provides therein a storing chamber for storing the viscous fluid while avoiding application of the shearing action from said rotor element to the viscous fluid, said storing chamber being axially defined by said base section of said rotor element and said wall surface of said heat-generating chamber, wherein said viscous fluid type heat generating apparatus further comprises:

a fluid circulating means for permitting a circulatory movement of the viscous fluid through said storing chamber and said fluid-holding gap via an open end of said tubular portion of said rotor element during the rotation of said rotor element; and a flow rate controlling means arranged adjacent to said open end of said tubular portion of said rotor element for adjustably changing an amount of flow of the viscous fluid circulated by said fluid circulating means.

2. The viscous fluid type heat generating apparatus according to claim 1, wherein said base portion of said rotor element has a cylindrical outer face continuous with said substantially cylindrical outer face of said tubular portion and defining a base portion of said outer face of said rotor element.

3. The viscous fluid type heat generating apparatus according to claim 1, wherein at least said cylindrical outer face of said tubular portion of said rotor element is formed as one of an axially straight and an axially tapered cylindrical outer face.

4. The viscous fluid type heat generating apparatus according to claim 1, wherein said base portion and said tubular portion of said rotor element are formed as an integral axially cylindrical element of said rotor element, and wherein said heat generating chamber of said housing is formed as an axially extending cylindrical chamber having a cylindrical wall surface.

5. The viscous fluid type heat generating apparatus according to claim 1, wherein said fluid circulating means comprises a passage providing a fluid communication between said fluid-holding gap and said storing chamber at a predetermined position adjacent to said open end of said tubular portion of said rotor element, and wherein said flow rate controlling means comprises a valve means arranged so as to adjustably change an amount of a cross-sectional area of the path of said passage.

6. The viscous fluid type heat generating apparatus according to claim 5, wherein said passage is formed in one of a portion of said open end of said tubular portion and a portion of said housing confronting said open end of said tubular portion of said rotor element, said passage allowing the viscous fluid to be supplied from said storing chamber to said fluid-holding gap, due to a centrifugal force acting on the viscous fluid in said storing chamber during the rotation of said rotor element.

7. The viscous fluid type heat generating apparatus according to claim 5, wherein said tubular portion of said rotor element has an outermost end face lying in a plane perpendicular to the axis of rotation of said drive shaft, wherein said heat-generating chamber of said housing has a part of said inner wall thereof confronting said outermost end face of said rotor element and defining a rear annular fluid-holding gap in which the viscous fluid generates heat in response to the rotation of said rotor element, and wherein said passage is formed so that it can increase and decrease said rear annular fluid-holding gap provided between said outermost end face of said rotor element and said part of said inner wall of said heat-generating chamber by said valve means.

8. The viscous fluid type heat generating apparatus according to claim 5, wherein said valve means is provided in said housing.

9. The viscous fluid type heat generating apparatus according to claim 8, wherein said valve means comprises a solenoid-operated valve means capable of being operated by a control signal provided from outside said viscous fluid type heat generating apparatus.

10. The viscous fluid type heat generating apparatus according to claim 9, wherein said solenoid-operated valve means comprises an axially movable rod element moving between an extended position where said rod interfaces with said passage, and a retracted position separated away from said passage.

11. The viscous fluid type heat generating apparatus according to claim 8, wherein said valve means is provided at one of a predetermined portion of said outermost end face of said rotor element and a predetermined portion of said drive shaft.

12. The viscous fluid type heat generating apparatus according to claim 11, wherein said valve means provided in said predetermined portion of said drive shaft comprises a centrifugally-operated valve element mounted on said drive shaft, said centrifugally-operated valve element being arranged to move toward an opening of said passage against a constant spring force, in response to a change in the rotating speed of said drive shaft.

13. The viscous fluid type heat generating apparatus according to claim 5, wherein said rotor element has a pair of axially opposite end faces lying in respective planes perpendicular to the axis of rotation of said drive shaft, wherein said heat-generating chamber of said housing has a pair of axially confronting inner wall faces which confront said pair of opposite end faces of said rotor element, respectively, to define a pair of annularly extending fluid-holding gaps, said pair of annularly extending fluid-holding gaps being a secondary part of said fluid-holding gap, and wherein said fluid circulating means comprises a first group of spirally arranged radial grooves formed in at least one of said pair of axially opposite end faces of said rotor element, which can function to promote the circulatory movement of the viscous fluid through said storing chamber and said fluid-holding gap, in response to an increase in the rotating speed of said rotor element within said heat-generating chamber.

14. The viscous fluid type heat generating apparatus according to claim 5, wherein said rotor element has a pair of axially opposite end faces lying in respective planes perpendicular to the axis of rotation of said drive shaft, wherein said heat-generating chamber of said housing has a pair of axially confronting inner wall faces which confront said pair of opposite end faces of said rotor element, respectively, to define a pair of annularly extending fluid-holding gaps, said pair of annularly extending fluid-holding gaps being a secondary part of said fluid-holding gap, and wherein said flow rate controlling means comprises a second group of spirally arranged radial grooves formed in at least one of said pair of axially opposite end faces of said rotor element, which can function to discourage the circulatory movement of the viscous fluid through said storing chamber and said fluid-holding gap, said second group of spirally arranged radial grooves acting to reduce an amount of circulating flow of the viscous fluid in response to an increase in the rotating speed of said rotor element.

* * * * *